US007277669B2

(12) United States Patent
Howe

(10) Patent No.: US 7,277,669 B2
(45) Date of Patent: Oct. 2, 2007

(54) SYSTEMS AND METHODS FOR SIMPLEX AND DUPLEX IMAGE ON PAPER REGISTRATION

(75) Inventor: Richard L. Howe, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/320,822

(22) Filed: Dec. 30, 2005

(65) Prior Publication Data

US 2006/0099019 A1 May 11, 2006

Related U.S. Application Data

(62) Division of application No. 11/101,425, filed on Apr. 8, 2005, now Pat. No. 7,158,751, which is a division of application No. 10/249,632, filed on Apr. 25, 2003, now Pat. No. 6,920,307.

(51) Int. Cl.
*G03G 15/00* (2006.01)

(52) U.S. Cl. ..... 399/395; 399/394; 400/579; 271/227

(58) Field of Classification Search ..... 399/394, 399/395; 400/579, 630; 271/184, 185, 226, 271/227, 228

See application file for complete search history.

(56) References Cited

U.S. PATENT DOCUMENTS

| | | | |
|---|---|---|---|
| 5,094,442 | A | 3/1992 | Kamprath et al. |
| 5,555,084 | A | 9/1996 | Vetromile et al. |
| 5,725,211 | A | 3/1998 | Blanchard et al. |
| 5,794,176 | A | 8/1998 | Milillo |
| 5,848,344 | A | 12/1998 | Milillo et al. |
| 5,930,577 | A | 7/1999 | Forsthoefel et al. |
| 6,019,365 | A | 2/2000 | Matsumura |
| 6,137,989 | A | 10/2000 | Quesnel |
| 6,168,153 | B1 | 1/2001 | Richards et al. |
| 6,168,365 | B1 | 1/2001 | Lee |
| 6,173,952 | B1 | 1/2001 | Richards et al. |
| 6,373,042 | B1 | 4/2002 | Kretschmann et al. |
| 6,374,075 | B1 | 4/2002 | Benedict et al. |

*Primary Examiner*—Ren Yan
(74) *Attorney, Agent, or Firm*—Oliff & Berridge, PLC

(57) ABSTRACT

Systems and methods of registering a sheet in an image reproduction, e.g., a xerographic, device use sheet parameters regardless of the tray or bin with which the sheets are associated, separate tallies of sheet registration correction factors for both sides of a sheet, and use registration errors detected on a first side of a sheet to generate correction factors concerning proper registration of the second side of that sheet. In embodiments, the systems and methods average registration errors for one particular side of a plurality of sheets to obtain a dampened error signal that is taken into account for registration of subsequent sheets on each respective sheet side. In embodiments, the systems and methods determine variations between actual and target system performance to affect subsequent sheet flow and registration.

3 Claims, 7 Drawing Sheets

SYSTEMS AND METHODS FOR SIMPLEX AND DUPLEX IMAGE ON PAPER REGISTRATION

This is a Divisional of application Ser. No. 11/101,425 filed Apr. 8, 2005, now U.S. Pat. No. 7,158,751 which is a Divisional of application Ser. No. 10/249,632 filed Apr. 25, 2003, now U.S. Pat. No. 6,920,307. The entire disclosure of the prior applications is hereby incorporated by reference herein in its entirety.

BACKGROUND OF THE INVENTION

1. Field of Invention

This invention is directed to systems and methods for positioning a substrate, such as, for example, paper, in a printing device.

2. Description of Related Art

In various reproduction systems, including xerographic printing, the control and registration of the position of imageable surfaces such as photoreceptor belts, intermediate transfer belts, if any, and/or images on such imageable surfaces, and the control and registration of images transferred to and developed on a substrate, such as for example, a sheet of paper, involve both initial and process control methods.

The registration of images on either or both axes, i.e., the lateral axis and/or the process direction axis, relative to the image bearing surface and to one another, includes adjusting the position or timing of the medium sheet with respect to the image forming system.

Paper skew is the angular deviation of the longitudinal axis of the substrate in the process direction and/or the angular deviation of the lateral axis of the substrate perpendicular to the process direction. The lateral edges are the edges of the sheet which are substantially parallel to the process direction. The process edges are edges of the sheet which are substantially perpendicular to the process direction. The process edges may be referred to as the leading edge and the trailing edge.

Conventional image on sheet or image on paper setup/calibration procedures detect, and correct for, any registration errors due to paper skew, and process edge registration errors in the process direction and/or lateral edge registration errors.

Various systems and methods have been developed to control registration of a developed image on paper by controlling medium sheet placement with respect to the developed image system. Examples of such registration systems include those described in U.S. Pat. Nos. 5,094,442; 5,555,084; 5,725,211; 5,794,176; 5,848,344; 5,930,577; 6,019,365; 6,137,989; 6,168,365; 6,168,153; 6,173,952; 6,373,042 and 6,374,075, each of which is incorporated herein by reference in its entirety.

U.S. Pat. No. 5,930,577 to Forsthoefel et al. discloses xerographic systems and methods for registering a first image on a first side of a substrate and a second image printed on a second side of the substrate. A sensor detects a leading edge and a trailing edge of the substrate while an encoder operatively connected to the motor of a motor driven transport produces a number of pulses per revolution. A counter counts the number of encoded pulses between the leading edge and the trailing edge. The controller determines the width of the substrate from the number of counted encoder pulses and from the distance the substrate advances per encoder pulse. The controller controls the document transport to position the substrate at the transfer station so that the second image is registered with the first image.

U.S. Pat. No. 5,094,442 to Kamprath et al. describes lateral and longitudinal simplex sheet position registration systems and methods which use sheet leading edge sensors to detect the transverse, longitudinal and skew positioning of a sheet in the sheet feed path and change sheet drive parameters to adjust for sheet mis-positioning.

U.S. Pat. No. 6,173,952 to Richards et al. describes systems and methods for simplex and/or duplex sheet registration in which selected sheets having a variety of sheet widths transversely of the sheet process path and are partially rotated by a transversely spaced-apart pair of differentially driven sheet steering nips. A control signal proportional to the width of an image substrate sheet to be moved in the process direction is obtained, and automatically increasing or decreasing the transverse spacing between the transversely spaced-apart pair of differentially driven sheet steering nips is automatically increased or decreased in response to a control signal indicative of an increasing or decreasing width of an image substrate sheet. A sheet length control signal is provided to a controller. The sheet length control signal may be generated by a conventional sheet length sensor measuring the sheet transit time between trail edge and lead edge passage of a sheet past a sensor, which may be mounted upstream of the sheet input into the process path. Alternatively, sheet length information may already be provided in the controller. Clean new sheets, or sheets already printed on one side being returned by a duplexer for re-registration, having a variety of sheet lengths may be reliably input fed and de-skewed and/or side registered by increasing the number of nip units spaced further upstream.

U.S. Pat. No. 5,794,176 to Milillo, describes adaptive electronic sheet registration systems and methods. A translating electronic registration (TELER) sheet drive roll system provides a very accurate method of correcting misalignment of sheets using speed controlled drive rolls to correct for skew mis-positioning and longitudinal sheet registration. An adaptive registration device provides continuous feedback from copies made earlier about sheet during operation of the electronic roll system. The number of machine clocks that elapse between the time light exposure of an original, called "flash", occurs until the exact instant that the trailing ends of a sheet reaches a specified point in the sheet process path is determined. A running average of the machine clocks for two sets of three registers is maintained, one set of three registers for longitudinal sheet registration and a second set of three registers for skew correction. The values for the current running average are used to adjust the algorithms which control longitudinal and skew motions of the copy sheets following the first copy sheet. The process is repeated throughout the copy operation. Because errors introduced through the TELER nip deformations are a function of paper weights and sizes, and each of the paper supply drawers can have a different size of paper, a separate set of registers is dedicated to each supply drawer for storage of adaptive registration parameters. This minimizes optimizing the number of machine clocks when a copy machine operator switches paper supply drawers. The appropriate number of sheets for which registration information should be maintained can vary, and a disclosed example is averaging over three sheets.

U.S. Pat. No. 5,848,344 to Milillo et al. describes a single unit copy media registration module which also uses an adaptive electronic registration system that provides continuous feedback about errors measured during operation of an electronic drive roll system and the adjustments that are made to correct them. A running average of the difference between actual substrate measurements and set up values is maintained in system memory and appropriate changes are made to algorithms that control associated motors to continually optimize substrate registration performance.

U.S. Pat. No. 6,019,365 to Matsumura describes xerographic substrate/sheet alignment systems that correct skew and side mis-registration of a duplex sheet to achieve proper registration of images on opposite sides of a single substrate/sheet. The edge of a sheet is detected while the sheet is being conveyed. In response to the result of the sheet side edge detection, the direction in which the sheet is rotated and/or shifted is controlled to simultaneously correct the skew and side mis-registration of the sheet.

U.S. Pat. Nos. 6,168,153 and 6,173,952 to Richards et al. describe sheet handling systems in a reproduction apparatus to correct the skew and/or transverse position sheets having a wide range of lengths in the process direction. The systems use a plurality of spaced apart sheet feed nips and may apply a control signal proportional to the width of the sheet.

U.S. Pat. No. 6,374,075 to Benedict et al. describes a high accuracy sheet cross-process registration system. In the simplex mode, a smart remote uses a CCD lateral sensor to measure the sheet lateral input position and input sheet skew. After the registration, the smart remote uses the CCD lateral sensor to check how well it did in reaching the lateral and skew targets. For the duplex mode, the fine registration correction is the same as in the simplex mode except that a process edge sensor on the sheet trail edge is used, eliminating the influence of sheet length variations on registration accuracy.

U.S. Pat. No. 5,555,084 to Vetromile et al. describes simplex and duplex sheet registration systems and methods. For simplex registration, a detector senses a common physical edge of a sheet when calculating a sheet's distance from a toner image at a transfer station. Sensors measure the lead edge of a sheet between sheet corners with reference to target marks and the sheet's trail edge on its duplex (back side) pass. Alternatively, the sensors may measure the trail edge of a simplex sheet and a lead edge of a duplex sheet. For the back side (duplex) pass, the sheet is registered to the trail edge of the sheet between corners. After image, sheet cut tolerance is shifted to the trail edge between sheet corners on the back (duplex) side of the sheet. Thus, the sheet-to-image registration shifts image offsets to a common edge of the sheet.

U.S. Pat. No. 5,725,211 to Blanchard et al. describes systems and methods for reducing and/or eliminating registration error during duplex printing in a multi-pass xerographic printing system. The images to be printed are aligned with a common physical edge of a sheet by using a sheet's lead edge on a simplex pass and the sheet's trail edge on a duplex pass. Common edge registration shifts image offset to a common edge of a sheet to reduce and/or eliminate image registration due to sheet cut tolerances.

U.S. Pat. No. 6,373,042 to Kretschmann et al. describes a registration system for a digital printer designed to ensure that images on both sides of a sheet are in registration with each other. In an embodiment, two types of image placement control occur. For sheets traveling through a feed path, a running average of measurements of the location of the side edge for a set of sheets apparatus, such as a running average of the last three sheets, is maintained, and this running average is used to control the placement of images on a subsequent sheet at any particular time. Further, the precise positions of side edges of sheets passing through the duplex path is measured by an optical sensor and reported to the image placement controller. A running average of the edge positions of previously-fed sheets can be used for controlling the placement of images on subsequent sheets passing through the duplex path. Further, and possibly in addition, by comparing the running averages of the side edge positions of sheets coming through the feed path and the duplex path, a "shift factor" or mathematical relationship between the relative positions of sheets coming through the feed path and the duplex path can be obtained. It is often found that the passage of a sheet through the duplex path often results in a side-to-side shift of the sheets passing therethrough, and the shift is fairly consistent for all sheets going through the path in a particular machine. By taking this consistent shift, as symbolized by the calculated shift factor, into account while the printer is running, the image placement controller can control the marking device to ensure registration of the first side image with the second side image on a single sheet.

Other, more computationally sophisticated techniques are also disclosed in the 042 patent. For instance, if the computing power available to the printing apparatus is fast enough, a system can be provided in which for a single sheet, the precise location of the sheet is determined immediately before the sheet is fed into the marking device, and the marking device is controlled to place an image with precision relative to the determined location of the side edge of the sheet. Further, when a the same sheet is duplexed, the process can be repeated using the side edge location as determined from a sensor in the duplex path. Another variation is to use a precise measurement of the side edge location of the sheet being printed in combination with a derived shift factor as determined by the difference in average side edge locations in the feed path and the duplex path.

U.S. Pat. No. 6,137,989 to Quesnel describes a simplex sheet registration system using an integral array sensor to measure the position of a sheet based on the number of pixels of the sensor which are covered by the edge of the sheet.

SUMMARY OF THE INVENTION

In describing the systems and methods of this invention, the terms substrate, medium, sheet and paper are used interchangeably.

The systems and methods of this invention provides systems and methods of sheet registration in a xerographic system that utilize sheet parameters regardless of the tray with which the sheets are associated.

The systems and methods of this invention separately provides systems and methods that use an expanded adaptive algorithm which maintains sheet parameters or characteristics independently of the tray in which the sheets are located.

The systems and methods of this invention separately provides systems and methods that separates tallies of sheet registration correction factors for both sides of a sheet to improve sheet registration where there are differences in sheet performance through a xerographic system from one side of a sheet to the other side of the sheet.

The systems and methods of this invention separately provides systems and methods that directly start using an appropriate array of sheet registration factors without having to wait for a rolling average of correction factors to remove no-longer-applicable factors from a sheet with different physical characteristics or parameters.

The systems and methods of this invention separately provides systems and methods that use registration errors detected on a first side of a sheet to generate correction factors concerning proper registration of the second side of the sheet, on a sheet-by-sheet basis.

The systems and methods of this invention separately provides systems and methods that average registration errors for both side 1 and side 2 of a plurality of sheets and generate a damped error signal that is taken into account regarding registration of subsequent sheets, on each respective side.

The systems and methods of this invention separately provides systems and methods of substrate registration that determine variations between actual and target system performance to affect subsequent substrate flow and registration.

The systems and methods of this invention separately provides systems and methods of substrate registration that attempt to obtain and/or infer feedback regarding exactly where an image was printed on side 1 of a substrate and use the feedback to fine tune where the image should be placed on side 2 of that substrate.

The systems and methods of this invention separately provides systems and methods of substrate registration that improve the relative alignment of an image on side 2 relative to that of the image on side 1 of a substrate on a sheet-by-sheet basis.

This invention separately provides systems and methods of substrate registration that use a measured feedback signal for one side of a substrate to alter the other side of that same substrate's control process or algorithm.

The systems and methods according to this invention separately provide for determining but not employing any registration error data and/or registration correction data when that error data and/or correction data may adversely affect at least one of several types of substrate registration, such as for example not using substrate registration correction data for process direction correction if that data may adversely affect process direction registration while not adversely affecting other types of registration, such as, for example, cross-process substrate registration and/or substrate skew registration.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
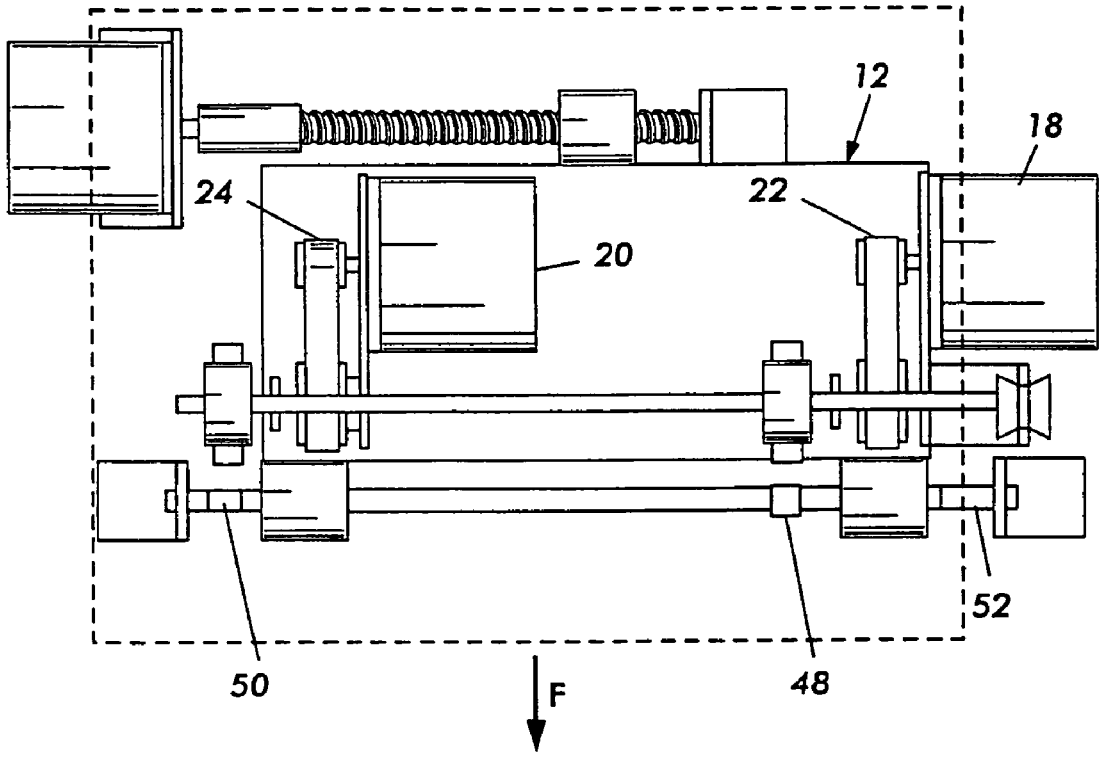
FIG. 1 is a top view of a substrate/sheet as it is conveyed through one exemplary embodiment of a substrate sheet positioning drive system for a reproduction device.

Registration errors which may be addressed by a registration system according to the systems and methods of this invention include lateral edge shifts, process edge shifts, and sheet skew. Registration errors which may be addressed by a registration system include lateral sheet shifts, process sheet shifts, and substrate/medium (e.g., paper) skew. Paper skew is defined above. FIG. 1 shows a sheet 70 which is being conveyed through the sheet feed system 10 of an image reproduction system.

The four edges of the sheet 70 can be described relative to the direction that the sheet 70 moves through the printing apparatus. An outboard edge (OB) 71 and an inboard edge (IB) 72 are edges that define the process length. The outboard edge 71 can refer to the edge of the sheet 70 closest to the operator of the image reproduction system, and the inboard edge 72 can refer to the opposite edge, i.e., the edge farthest from an operator, or vice versa. A leading edge (LE) 73 and a trailing edge (TE) 74 are edges that define the lateral width of the sheet 70. The leading edge 73 is the forward edge as the sheet 70 moves through an image reproduction device, and the trailing edge 74 is the opposite edge.

One sheet registration error to be determined using the systems and methods according to this invention is substrate/sheet skew, i.e., the amount of rotation of the sheet about the outboard registration edge.

A second sheet registration error to be determined using the systems and methods according to this invention is the image-to-paper position in the process direction. In various exemplary embodiments, the substrate may be lead-edge-registered on the first side 1 and be trail-edge registered on the second side.

A third error which may be determined using the systems and methods according to this invention is substrate/sheet lateral, i.e., cross-process, direction position.

Various exemplary embodiments of the systems and methods according to this invention employ image on sheet setup/calibration procedures, discussed in detail below, as a basis to detect, and correct for, any paper skew errors, and/or any lateral and/or process direction errors. The sheet registration systems and methods according to this invention may include a setup procedure, by a technician, for example, who determines, after an image has been transferred to a sheet, when the sheet has been properly registered.

After completion of a setup operation, the registration is designed to be "perfect" at, for example, the outboard edge of the first side of a substrate, at the leading edge of the first side of the substrate, and at the trailing edge of the second side the substrate and, optionally, in the cross-process direction.

The systems and methods according to this invention are usable with a wide variety of sheet registration mechanisms, such as, for example, in one exemplary embodiment, an adaptive electronic sheet registration system (AERS), the translating electronic registration (TELER) system, shown in FIG. 1.

FIG. 1 shows an adaptive electronic sheet registration system which includes a carriage 12 having two drive rolls 22 and 24 which are mounted thereon in rotatable fashion, and are driven by drive motors 18 and 20. The roll pairs engage a copy medium and drive it through the TELER system. The system includes optical sensors which will detect the presence of the edges of copy media. Two sensors 48 and 50 are mounted on the a carriage adjacent the drive rolls for lead edge detection of the copy media and control of motors. The sequence of engagement of the sensors and the amount of time between each detection is utilized to generate control signals for correcting skew (rotational mis-positioning of the copy media about an axis perpendicular to the copy media) of the copy media by variation in the speed of the drive rolls. A sensor 52 is arranged to detect the top edge of the copy media and the output therefrom is used to control a transverse drive motor.

The two skew sensors are also used to make similar measurements on the trailing edge of the sheet. These trail edge measurements are then compared to the values that a particular sheet should have based on the result of a system image-to-substrate alignment setup and/or sheet size and/or mass, and in this way, an error signal is generated. The error signal is then averaged over a plurality of sheets which have recently been run through the image reproduction system, such as, for example, a xerographic system. In one exemplary embodiment of the systems and methods according to this invention, the error signal is averaged over 10 sheets having substantially or exactly the same characteristics, such as, for example, sheet mass, to reduce sheet-to-sheet performance noise. It should be appreciated that the number of sheets over which the error signal is averaged may vary.

Figure 2:
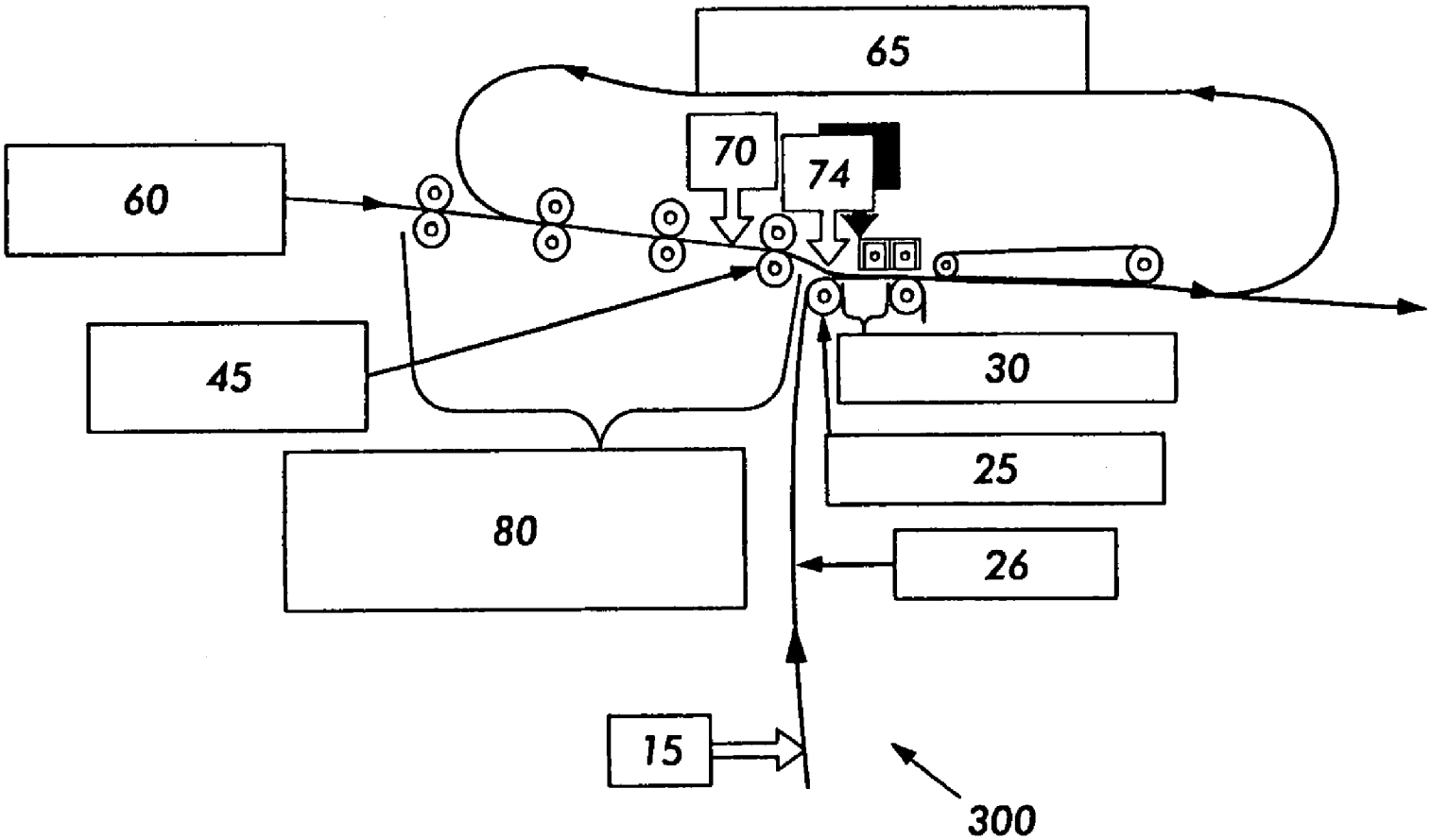
FIG. 2 is a perspective view of an exemplary reproduction system usable with the substrate registration systems and methods according to this invention.

In various exemplary embodiments of this invention, the adaptive electronic sheet registration system shown in FIG. 1, may be used in any suitable image reproduction system 300 such as, for example, the xerographic system shown in FIG. 2. A TELER registration system is identified as element 80 in FIG. 2. The xerographic system 300 may include registration system drive rolls 45 and element(s) 60 are upstream sheet feeding units or modules. Element 65 is a duplex sheet feed path. Element 70 is a nip release sensor to determine when nips upstream of nips 45 should be opened to allow nips 45 to have full control of the sheet. Element 74 is a sheet skew sensor, and may contain a plural number of sensors. Element 30 is an image to sheet transfer zone, element 25 is a photoreceptor drive roll and element 26 is a photoreceptor. Element 15 is a Raster Output Scanner or other image forming device In various exemplary embodiments, the systems and methods according to this invention utilize substrate/sheet adaptive parameters based on actual physical characteristics of the substrate/sheet itself. This differs from the aforementioned 176 patent in which the adaptive parameters are maintained in the reproduction system for each paper supply tray. Various exemplary embodiments of the systems and methods according to this invention use adaptive parameters which can result in more accurate substrate/sheet registration than in the 176 patent, for example, under the circumstances where, for example, a user changes paper from lightweight to heavyweight, in the same tray. In the 176 patent, the system will use the same parameters for the heavyweight substrate as for the lightweight substrate.

Various exemplary embodiments of the systems and methods according to this invention maintain substrate/sheet adaptive parameters separately or independently for each side, which reflects the fact that, under certain circumstances, the registration performance of side 1 of a substrate/sheet will be different than side 2 of the same substrate/sheet after it has been put through the fuser path and the duplex path portions of a sheet feed path. Under such circumstances, the curl of side 1 may be changed significantly, and its physical dimensions, including length, width, squareness, etc. may be changed. Moreover, sheet curl changes may alter sensor trip times, and sheet dimensional changes may change the relative placement of the side 1 and side 2 images, especially in the process direction. Ink weight may also be taken into consideration, although for typical area coverages, toner thicknesses and sheet masses (e.g., GSMs), toner represents less that about one percent of the sheet mass.

By maintaining separate substrate/sheet adaptive parameters for side 1 and side 2 of a substrate/sheet, many side-dependent adaptive parameter differences can be taken into consideration and accounted for, thereby resulting in improved substrate/sheet registration relative to systems which do not maintain separate substrate/sheet adaptive parameters.

The systems and methods according to this invention aim to achieve optimum side 2 to side 1 image alignment, although they also aim to achieve proper alignment of the side 1 image relative to the substrate and alignment of the side 2 image relative to the substrate.

In various exemplary embodiments of the systems and methods according to this invention, the skew sensors measure the trail edge process direction registration and skew data of sides 1 and 2 of each sheet, respectively, and these measurements are subtracted, respectively, from the values that a sheet is expected to have to be in registration to generate errors for proper registration. These error values for each sheet are averaged over a number of sheets to obtain a "damped" error signal. The resulting "damped" error signal will be factored into the commands sent for subsequent sheets, on the corresponding sheet side, as explained in more detail, below According to various exemplary embodiments of the systems and methods of this invention, the resulting "damped" error signal is then fed back and incorporated into the generation of the drive motor velocity profiles used for the next sheet to attempt to correct for any long-term errors that may exist in the system.

In other various exemplary embodiments of the systems and methods according to this invention, the raw, unaveraged or "undamped" side 1 error values for each sheet are incorporated into the commands sent to correct the registration of side 2 of the same sheet. In one exemplary embodiment of the systems and methods according to this invention, if the side 1 sheet registration measurements indicate that the leading edge of side 1 of the sheet arrived late to the transfer area, this would indicate, in a face down sheet bind edge leading substrate transport system, that the leading edge of side 1 of the sheet is further to the right relative to the image than is desired when side 1 is viewed conventionally. With respect to side 2 of the same sheet, which is recirculated via a duplex path to the image transfer area, this side 1 error is combined with the command that effectively controls process direction sheet timing in such a way that on side 2 the sheet is intentionally delivered to the image transfer station/area earlier than desired, but is, therefore, better aligned relative to the side 1 image of the sheet. A similar strategy may be applied to skew errors. Additionally, a similar strategy may be employed for cross-process direction registration in systems which, for example, employ "after correction" feedback measurements for cross-process direction registration.

In further exemplary embodiments of the systems and methods of this invention, certain substrate properties, such as, for example, size, orientation and substrate mass, are categorized as "buckets" which are independently maintained by the system to use as the basis for adaptive correction factors. In other words, for each substrate being run in an image reproduction, e.g., xerographic, system, its bucket or category is determined and only substrate registration correction factors which apply to that bucket or category are used to adaptively correct the commands sent to control feeding of a substrate/sheet in that category. Moreover, in various exemplary embodiments of the systems and methods according to this invention, the expanded adaptive algorithm maintains separate tallies of the respective correction factors for substrate side 1 and substrate side 2 to determine if there are any differences in sheet performance through the image reproduction, e.g., xerographic, system on the two sides, as might be the case, for example, due to fuser-induced curl, for example.

In various exemplary embodiments of the systems and methods according to this invention, all substrates to be run on a given xerographic system are first categorized, i.e., placed in categories or buckets which are based on a combination of several factors. In one exemplary embodiment, for example, the factors may be substrate mass per unit area, which may be expressed in terms of grams per square meter (GSM), substrate feed orientation, such as, for example, landscape or portrait, and substrate size, such as, for example, A4, ledger, etc., including such features as length and width. In this regard, reference is made to copending U.S. patent application Ser. Nos. 10/248,590 and 10/248,591, each of which was filed on Jan. 30, 2003, the subject matter of which is incorporated by reference herein in its entirety. These incorporated by reference applications disclose details of such buckets.

Various exemplary embodiments of the systems and methods of this invention recognize that printing systems handle a variety of substrates, e.g., paper sheet weights, and that a convenient way to express different paper weights is to express the weight of a given substrate sheet in terms of its paper mass per unit area, e.g., in the International Standards Association (ISO) metric system, in which the weight of the paper is given in terms of grams per square meter (GSM). For example, 20 pound letter stock corresponds roughly to 75 GSM, 24 pound letter stock corresponds roughly to 90 GSM, 28 pound letter stock corresponds roughly to 105 GSM. Bristol board, on the other hand, which has a different basis size, corresponds roughly to 44 GSM. Other known substrates can have substantially different paper masses, some over 280 GSM.

In various exemplary embodiments, the substrate feed orientation may be obtained from the substrate feed tray. The other attributes may be available from a media database for a particular image reproduction, e.g., xerographic, system. Typical media parameters found in a media database are: GSM, size, coated vs. uncoated, tabbed or un-tabbed, color, etc.

In one exemplary embodiment of the systems and methods of this invention, the twelve categories/buckets listed in Table 1 are used.

TABLE 1

| Bucket # | Substrate Weight (gsm) | Feed Orientation | Substrate Size |
|---|---|---|---|
| 1 | gsm < 73 | LEF | Short side < 155 mm |
| 2 | gsm < 73 | LEF | Short side ≧ 155 mm |
| 3 | gsm < 73 | SEF | Long side < 370 mm |
| 4 | gsm < 73 | SEF | Long side ≧ 370 mm |
| 5 | 73 ≦ gsm ≦ 150 | LEF | Short side < 155 mm |
| 6 | 73 ≦ gsm ≦ 150 | LEF | Short side ≧ 155 mm |
| 7 | 73 ≦ gsm ≦ 150 | SEF | Long side < 370 mm |
| 8 | 73 ≦ gsm ≦ 150 | SEF | Long side ≧ 370 mm |
| 9 | 150 < gsm | LEF | Short side < 155 mm |
| 10 | 150 < gsm | LEF | Short side ≧ 155 mm |
| 11 | 150 < gsm | SEF | Long side < 370 mm |
| 12 | 150 < gsm | SEF | Long side ≧ 370 mm |

Moreover, because separate substrate/sheet adaptive parameters are maintained for side 1 and side 2 of a substrate/sheet, there are 24 adaptive parameters maintained per substrate/sheet and for a given registration parameter, such as, for example, skew or process direction registration.

In various exemplary embodiments of the systems and methods according to this invention, a first-in, first-out (FIFO) non-volatile memory (NVM) array may be created for each bucket and for both sides 1 and 2, and for both substrate/sheet process direction and substrate/sheet skew, resulting in 48 adaptive parameter arrays in the system. Each array may hold a number, for example, 10, of the most recent values of an appropriate substrate/sheet registration error term. Moreover, in the case of a process direction substrate/sheet registration error, an accounting may be made for the actual size of the sheet. In other words, even though, for example, if one considers buckets 2, 6 or 10, the substrate size as listed in Table 1 requires that the short side is greater that, or equal to, 155 mm in length, this size parameter includes 8.5"×11" sheets, long edge feed (LEF) sheets and A4 long edge feed (LEF) sheets, i.e., including papers of different lengths, the systems and methods according to this invention account for these different sized papers, such as, for example, using a sheet length detector, although they fall within the same bucket.

Various exemplary embodiments of the systems and methods of this invention also provide for a user to input appropriate substrate stock identification numbers and/or characteristics from a substrate/media database, so that even when trays are changed, an image reproduction, e.g., xerographic, system using the systems and methods of this invention will be able to directly start using an appropriate array of correction factors without having to wait for the rolling average discussed above to flush out any no-longer-applicable values from previously used substrates/media.

In various other exemplary embodiments, a number of substrate parameter arrays may be maintained for every single stock in a substrate/media database.

As indicated above, data is obtained by measuring a first image on the first side and a second image on the second side. Obtaining the data can include any suitable known or later developed method of measuring the sizes of the first and second images and determining the positions of the first and second images on the sheet. Measurements can be taken by any known, or later developed, manual or automated method. Similarly, obtaining the data can include storing the data into any suitable storage or memory device, including, but not limited to, electronic memory. Obtaining the data can also include accessing data that has already been obtained, stored or recorded in prior processes.

Analyzing the data can include any known or later developed, manual or automated process of evaluating the obtained data. Analyzing the data can include employing the data in any routine or algorithm that will provide adjustments to overcome sheet position error.

Adjusting the sheet position includes any suitable known or later developed method of adjusting the sheet position using the adjustments obtained in analyzing the data. Adjusting sheet position also includes any mechanical or electrical manipulations that are made to alter the sheet position relative to the transfer member. This also includes any electronic or mechanical processes for implementing the adjustments.

In various exemplary embodiments, all of the aforementioned substrate sheet values can be determined during the setup operation and stored in the non-volatile memory of the image reproduction, e.g., xerographic, device. In various other exemplary embodiments, the measurements and determinations can be made at least in part by a system user.

Figure 3:
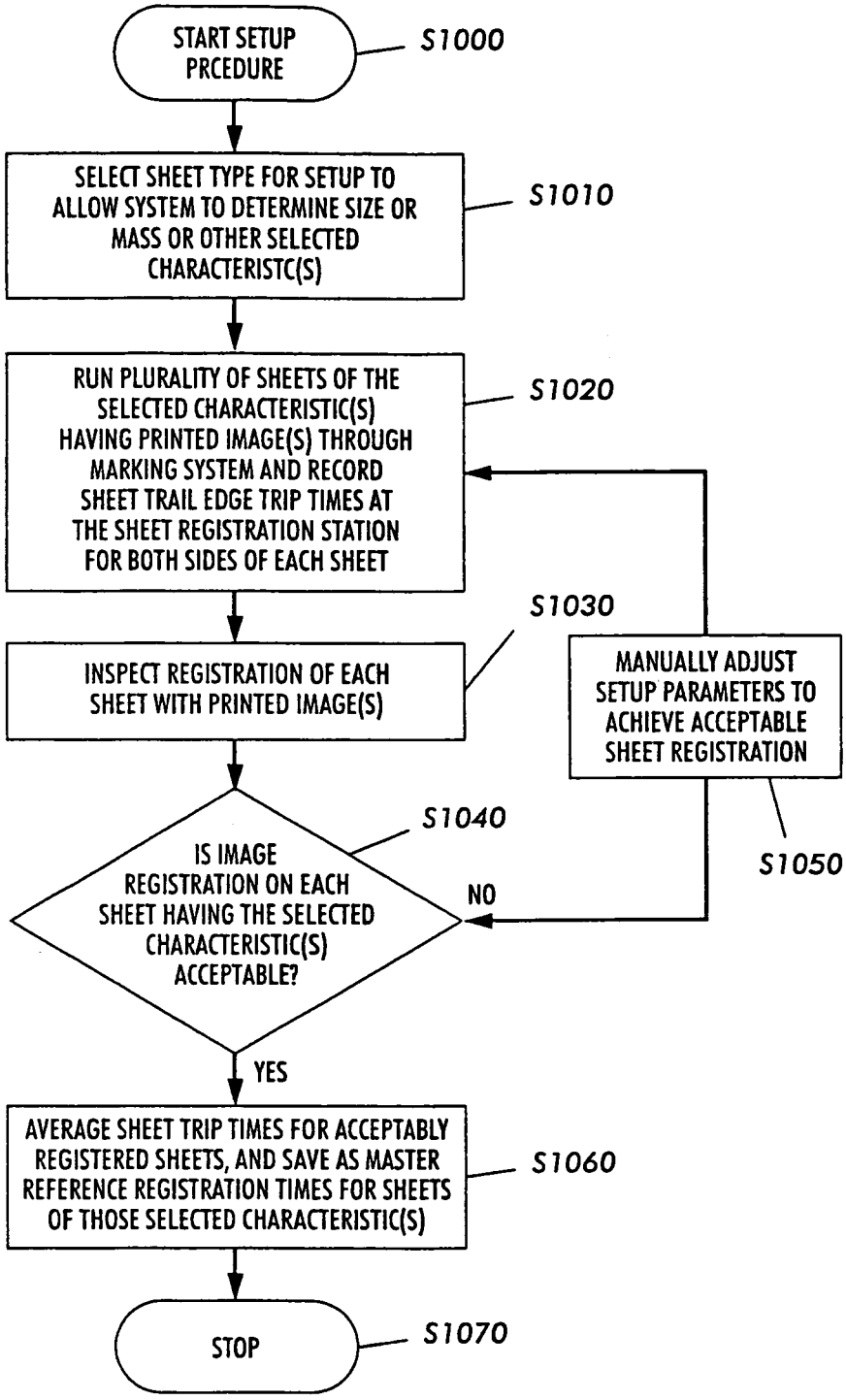
FIG. 3 shows a flowchart outlining an exemplary embodiment of a method of substrate registration setup calibration for a particular reproduction machine according to this invention.

FIG. 3 shows a flowchart outlining an exemplary embodiment of a method of substrate registration setup calibration for a particular reproduction machine according to this invention. Control starts in step S1000 and proceeds to step S1010, where a sheet having specific characteristics, such as, for example, a specific sheet mass and/or sheet size, to be used in the setup calibration procedure, is selected. As indicated in step S1010, the system may determine size, mass and/or other sheet characteristics, for example, using any known or hereinafter developed technique. Then, control proceeds to step S1020, where a plural number of sheets with the selected characteristic(s) and having a printed image on each side thereof, are run through the marking system. Sheet trail edge times at the sheet registration station of the marking system are determined and recorded for both sides of the sheets, using substrate trailing edge process direction sensors. In one exemplary embodiment of the systems and methods according to this invention, ten (10) sheets are run. The number of sheets may vary and may be selected based, for example, on the amount of dampening of sheet-to-sheet performance noise reduction that is desired.

Control then continues to step S1030, where each of the plural number of test prints is inspected for registration accuracy. In this regard, the test sheets typically are provided with indicia, such as, for example, fiducial marks, to aid in a determination of sheet registration accuracy. The inspection is typically performed by a technician but may be performed automatically using suitable sensors, or may be performed both manually and automatically. Then control jumps to step S1040, where a determination is made whether the test print images on the selected sheets have acceptable image transfer registration. If not, control proceeds to step S1050 where a technician manually adjusts one or more marking system setup parameters to achieve acceptable sheet registration. Control then proceeds to step S1020 to run another plurality of sheets. However, if image registration is acceptable, then control proceeds from step S1040 to step S1060, where a determination is made of average sheet trip times for acceptably registered sheets, and these average sheet trip time values are saved as master reference registration times for sheets having the selected characteristics Then, control proceeds to step S1070, where the process ends.

As noted above, these master setup registration values are obtained for both side 1 and side 2 of the sheet and are separately stored as such.

Figure 4:
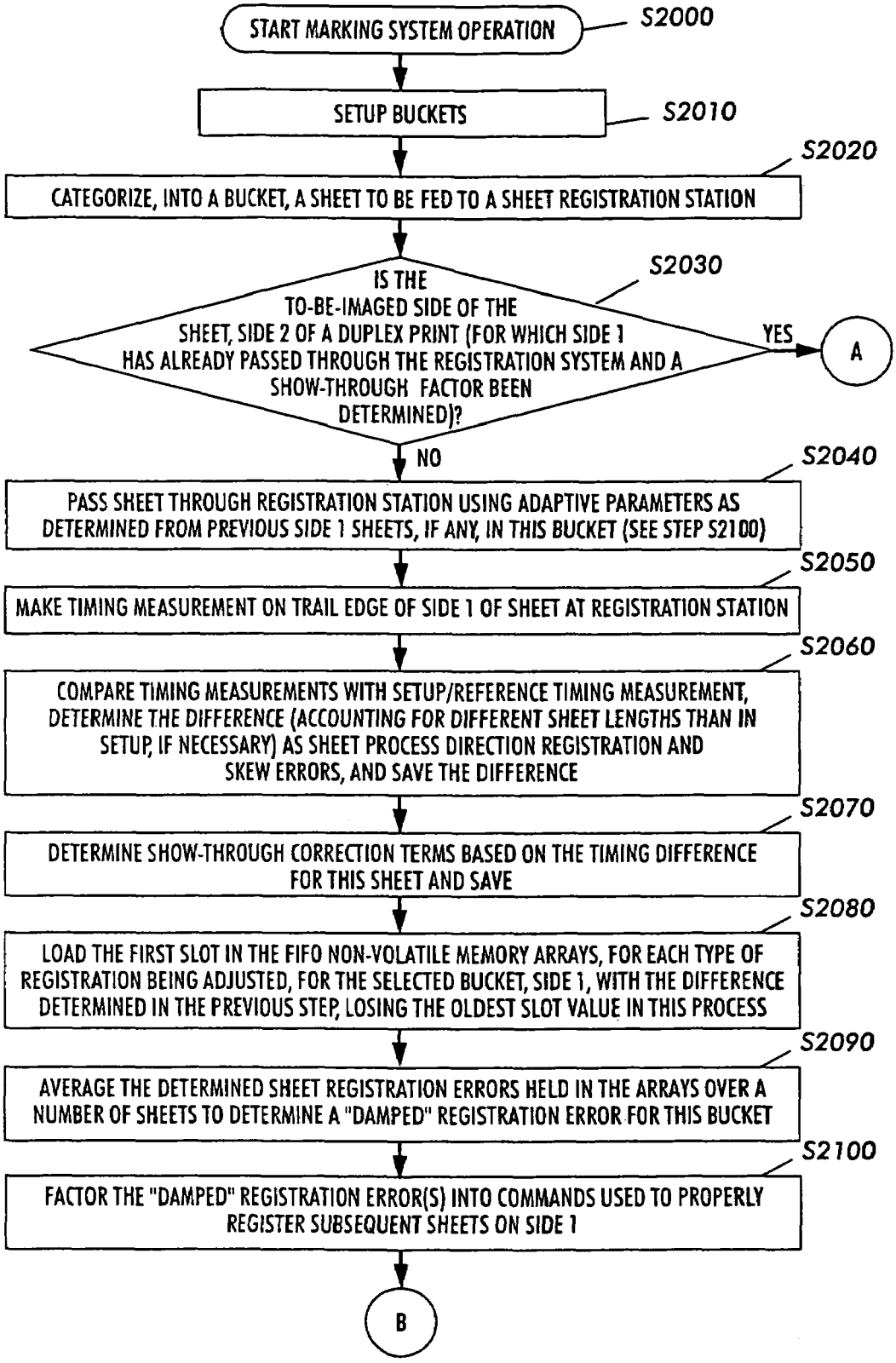
FIGS. 4-6 show a flowchart of one exemplary embodiment of a method of sheet registration in a reproduction device according to the systems and methods of this invention.
Figure 5:
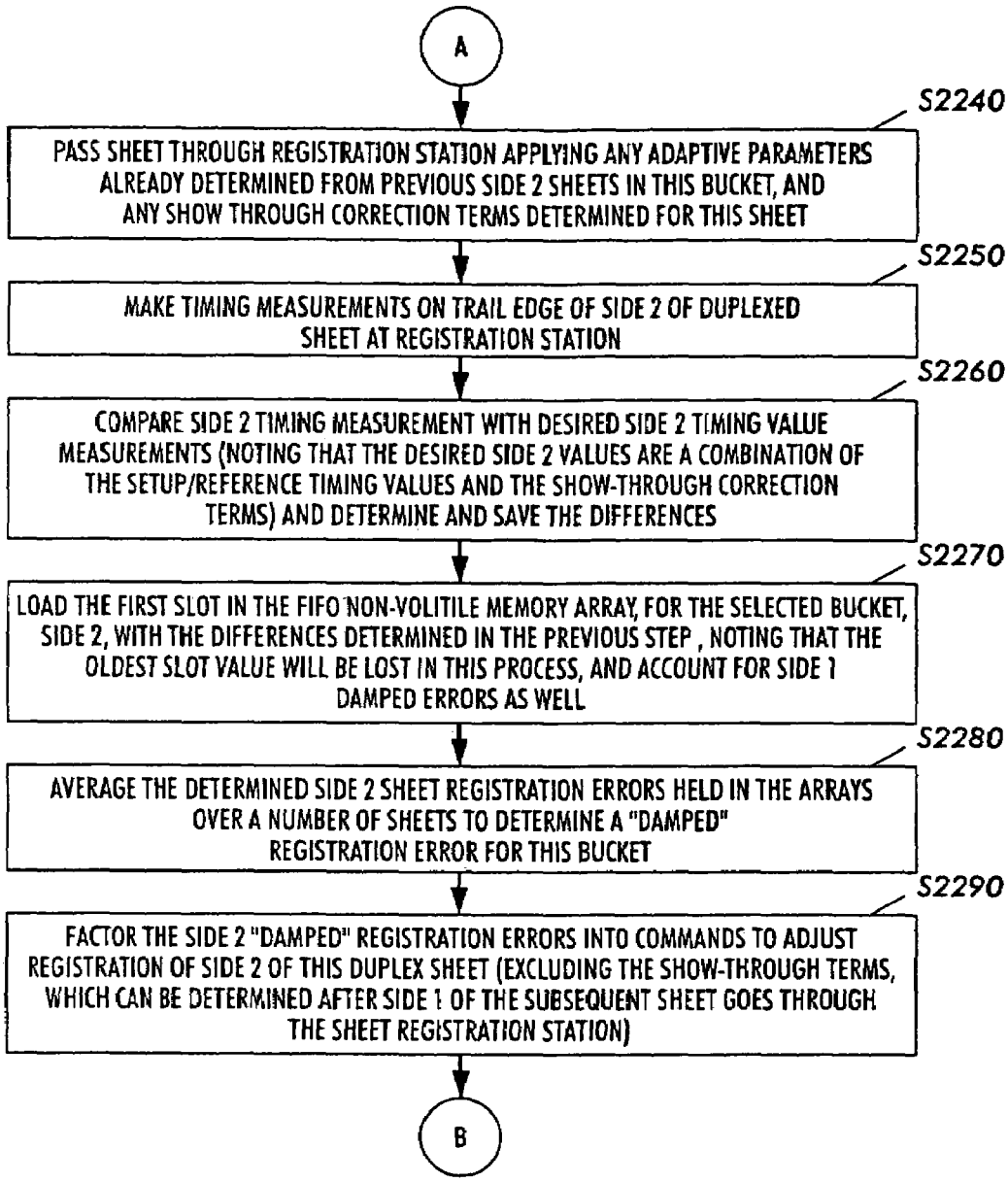
Figure 6:
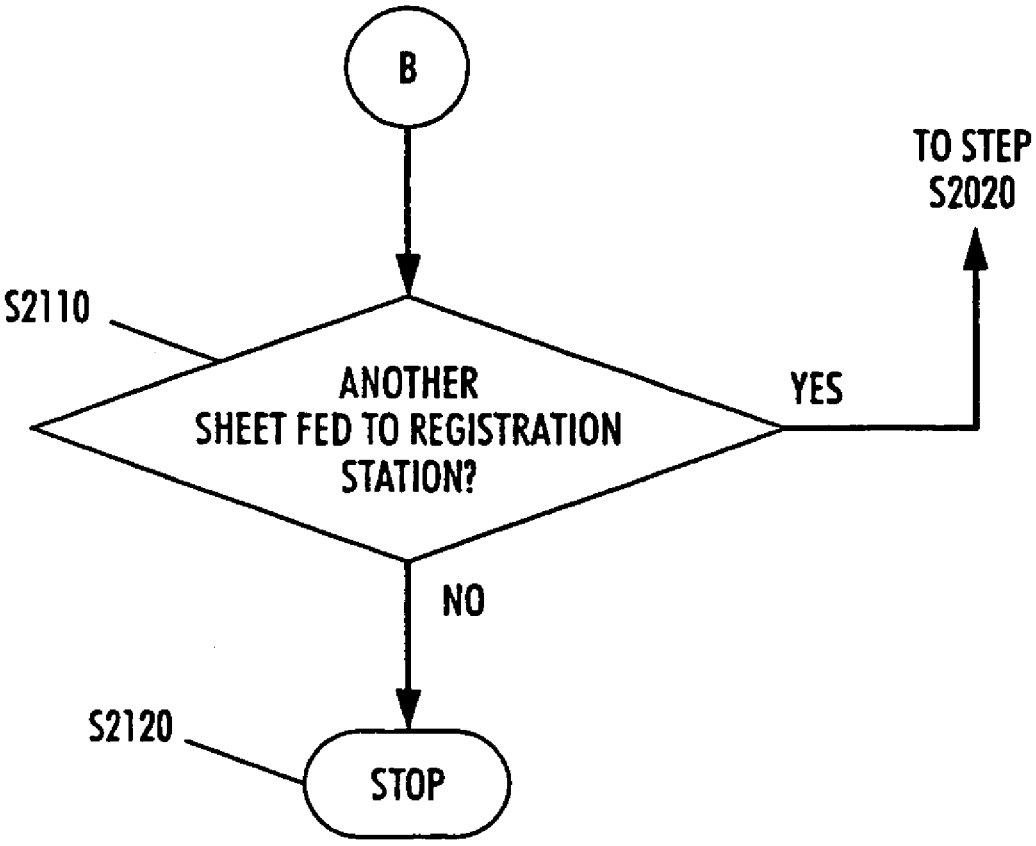

FIGS. 4-6 show a flowchart which illustrates procedures for providing accurate post-transfer image registration in a reproduction machine after initial machine registration setup. Control starts in step S2000 and proceeds to step S2010. In step S2010, buckets are set up, for example, as described in the incorporated '590 and '591 applications. Briefly, empirical sheet handling data is obtained for each of the twelve different buckets, such as, for example, time to advance a sheet with the characteristics of bucket No. 7. That empirical data is loaded into the memory of, or associated with, a reproduction machine and may be used to control registration of the sheets along with any registration error information detected with respect to one or more sheets. As explained above, in various exemplary embodiments of the systems and methods according to this invention, a first-in, first-out (FIFO) non-volatile memory (NVM) array may be created for each bucket and for both sides 1 and 2, and for both substrate/sheet process direction and substrate/sheet skew, resulting in 48 adaptive parameter arrays per substrate/sheet. Each array may hold a number, for example, 10, of the most recent values of an appropriate substrate/sheet registration error term.

In the instance of a first sheet being detected by the reproduction machine registration sensor(s), the error values will all be set to zero because no sheets have been previously run. As more sheets are run, more registration error values are entered into the non-volatile memory arrays to be averaged to obtain "damped" adaptive registration values.

In one exemplary embodiment of the systems and methods according to this invention, a FIFO array of non-volatile memory elements is used to average the registration correction factors over the latest specified number, e.g., 10, of sheet registration correction values to obtain the "damped" adaptive registration values.

Once the buckets are set up, control proceeds to step S2020, where a sheet to be fed to a marking system sheet registration station is categorized into a particular bucket. Then, control proceeds to step S2030, where a determination is made whether the side of this sheet which is to be imaged is side 2 of a duplex print (for which side 1 has already passed through the registration system and a show-through factor has been determined). If not, then, control proceeds to step S2040, where the sheet is passed through the registration station using adaptive registration parameters and/or factors as determined from previous side 1 sheets, if any, in this bucket. Next, control proceeds to step S2050, where the arrival/trip time of side 1 of the sheet that just arrived at the registration station is made.

Next, control proceeds to step S2060 to where the timing measurement made in the previous step is compared with the setup/reference timing measurement to determine the different between them as shift process direction registration errors and sheet skew errors, and the difference, if any, is saved. As noted above, if the sheet involved is of a different length, for example, that the setup sheets, then the marking system controller takes this difference into consideration.

Then, control proceeds to step S2070 to determine the show-through correction term based on the timing difference for this sheet, and saves that term. The show-through (or see-through) correction is based on determining what registration errors, if any, were detected for side 1, determining the inverse of those errors, and applying the inverse of those errors to side 2 of the same sheet along with the aforementioned adaptive "damped" correction factors. The purpose of applying an inverse correction to side 2 of an individual sheet is to achieve proper image registration on both sides of the sheet, so that the image on side 2 of the sheet is coincident with an image on side 1 of the sheet. The mis-registration of images of the same size on opposite sides of a sheet is known as "see-through" and/or "show through" in the sense that the image on one side can be seen relative to the location of the image on the opposite side of the sheet. Next, control proceeds to step S2080, where the first slot of the non-volatile memory arrays are loaded, for each type of registration (e.g., skew, process, or cross-process registration) being adjusted, for the selected bucket, side 1, with the difference that has been determined in step S2060, losing the oldest slot value in the process.

Next, control proceeds to step S2090, where the determined sheet registration errors held in the arrays are averaged over a number of sheets to determine a "damped" registration error for this bucket.

Then control proceeds to step S2100 where the "damped" registration error(s) are factored into commands used to properly register subsequent sheets on side 1 of those sheets (these are actually used the next time step S2040 is executed).

If, in step S2030, it was determined that the to-be-imaged side of the sheet is side 2 of a duplex print (for which side 1 has already passed through the registration system), control proceeds to step S2240, where a sheet which is passing through the sheet registration station has applied to it any adaptive registration parameters and/or factors already determined from previous side 2 sheets in this bucket, and any show-through terms determined for this sheet.

Next, control proceeds to step S2250, where timing measurements are made on the trail edge of side 2 of a duplexed sheet at the sheet registration station.

Then, control proceeds to step S2260, where the side 2 timing measurement of the sheet is compared with the desired side 2 value timing measurements to produce error terms. This comparison accounts for whatever show-through terms were utilized for side 2 so that the resulting error terms truly reflect how well the sheet was registered relative to where it was commanded to be registered (and note that where it was commanded to be registered was a combination of the reference time values and any show-through correction terms).

Control then proceeds to step S2270, where the first slot in the FIFO non-volatile memory arrays (or their equivalent) are loaded for each registration error addressed for the selected side 2 bucket, with the differences determined in the previous step. It should be noted that the oldest slot value will be lost in this process.

Next, control moves to step S2280, where the determined side 2 sheet registration error values held in the arrays are averaged over a number of sheets to determine a "damped" registration error for this (side 2) bucket.

Control then proceeds to step S2290, where the side 2 "damped" registration errors are factored into commands to adjust the registration of side 2 of this duplex sheet, excluding the show-through terms, which can only be determined after side 1 of the subsequent sheet goes through the sheet registration station.

Then, control proceeds to step S2110 to determine if another sheet has been fed to the sheet registration station. If so, control jumps back to step S2020 and repeats the process. If not, control proceeds to step S2120, where the process ends.

It should be understood that the systems and methods according to this invention also determine, using substrate trail edge sensor data, when process direction registration controls do not achieve desired sheet process direction registration for some reason, such as, for example, inadequate correlation between trail edge timing measurements and actual image to substrate alignment performance. Under such circumstances, the systems and methods according to this invention disregard process error correction factors and merely apply skew and/or cross-process direction registration control factors. In one exemplary embodiment of the systems and methods of this invention, where process direction control correction factors are not achieving acceptable process direction controls, one may turn off the adaptive control strategy regarding side 1 of the substrate, including not generating a "show-through" image correction term. In this exemplary embodiment, one would only use process direction registration values generated for side 2 for a duplex transfer image.

Figure 7:
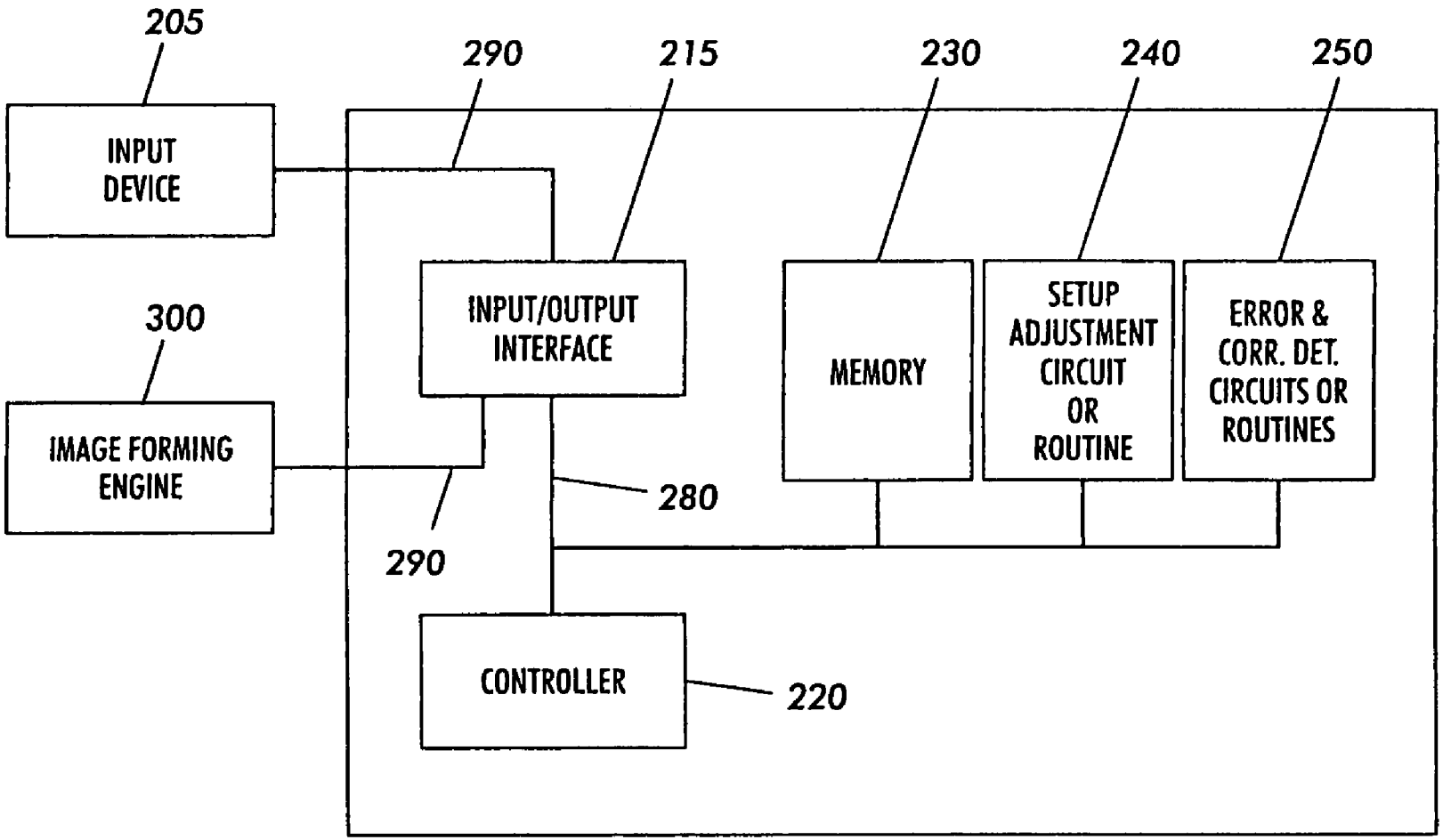
FIG. 7 is a functional block diagram of one exemplary embodiment of a control system according to this invention.

FIG. 7 is a functional block diagram of one exemplary embodiment of a control system 200 according to this invention. The control system 200 is usable to generate and apply the corrections discussed above, and to controllably output the shifted image data to an image forming engine 300 based on the determined corrections. As shown in FIG. 7, the control system 200 includes an input/output interface 215, a controller 220, a memory 230, a setup adjustment circuit, application or routine 240, and a sheet position error and error correction determination circuit, application or routine 250, interconnected by a data/control bus 280 or the like. One or more input devices 205 are connected by a link 290 with the input/output interface 215.

As shown in FIG. 7, the memory 230 can be implemented using either or both of alterable or non-alterable memory. The alterable portions of the memory 230 are, in various exemplary embodiments, implemented using static or dynamic RAM. However, the alterable portions of the memory 230 can also be implemented using a floppy disk and disk drive, a writable optical disk and disk drive, a hard drive, flash memory or the like. Non-alterable portions of the memory 230 are, in various exemplary embodiments, implemented using ROM. However, the non-alterable portions can also be implemented using other memory devices, such as PROM, EPROM, EEPROM, an optical ROM disk, such as a CD-ROM or a DVD-ROM, and disk drive, or other non-alterable memory, or the like.

Thus, the memory 230 can be implemented using any appropriate combination of alterable, volatile, or non-volatile memory or non-alterable or fixed memory. The alterable memory, whether volatile or non-volatile, can be implemented using any one or more of static or dynamic RAM, a floppy disk and disk drive, a writable or re-writable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or a DVD-ROM disk and disk drive or the like.

It should be appreciated that the control system 200 shown in FIG. 7 can be implemented as a portion of a programmed general purpose computer used to control the overall operation of the image forming engine. Alternatively, the control system 200 can be implemented using an ASIC, a FPGA, a PLD, a PLA, or a PAL, or using physically distinct hardware circuits, such as discrete logic elements or discrete circuit elements. Alternatively, the control system 200 can be implemented as a portion of a software program usable to form the overall control system of the image forming engine. In this case, each of the controller 220 and the various circuits or routines 240-250 can be implemented as software routines, objects and/or application programming interfaces or the like. The particular form the controller 220 shown in FIG. 6 will take is a design choice and will be obvious and predictable to those skilled in the art.

In general, the one or more input devices 205 may include any one or more of a keyboard, a keypad, a mouse, a track ball, a track pad, a touch screen, a microphone and associate voice recognition system software, a joy stick, a pen base system, or any other known or later-developed system for providing control and/or data signals to the control system 200. The input device 205 can further include any manual or automated device usable by a user or other system to present data or other stimuli to the control system 200.

The link 290 can be any known or later-developed device or system for connecting the input device(s) 205, the image forming engine 300 and the control system 200, including a direct cable connection, a connection over a wide area network or a local area network, a connection over an intranet, a connection over the Internet, or a connection over any other known or later-developed distributed processing network or system. In general, the link 290 can be any known or later-developed connection system or structure usable to connect the input device(s) 205, the image forming engine 300 and to the control system 200.

In operation, system sensors are used to make edge measurements which are automatically entered into the controller 220. The measurements may be made and entered manually, however. The various measurements obtained from the registration test image are then stored by the controller 220 in the memory 230.

The controller 220 then accesses the measurements stored in the memory 230 and supplies the accessed measurements to the sheet position error and error correction determination circuits or routines 250 which use algorithms to determine substrate/sheet registration mis-registration and corrections therefor. The setup adjustment circuit or routine 240, under control of the controller 220 and in cooperation with the image forming engine 300, may perform an automatic sheet registration setup adjustment. Upon completing the setup adjustment operation performed by the setup routine or circuit 240, the controller 220 stores the data generated by the setup circuit or routine 240 in the memory 230. This data may be used to determine the setup values discussed in the exemplary process shown in FIGS. 3-6.

While this invention has been described in conjunction with the specific embodiments above, it is evident that many alternatives, combinations, modifications, and variations are apparent to those skilled in the art. Accordingly, the exemplary embodiments of this invention, as set forth above are intended to be illustrative, and not limiting. Various changes can be made without departing from the spirit and scope of this invention.

What is claimed is:

1. A method of image on paper registration, comprising:

obtaining (i) process direction registration error correction data and (ii) skew and/or cross-process direction registration error correction data from sensors that detect a physical feature of a substrate;

applying (i) the process direction registration error correction data and (ii) the skew and/or cross-process direction registration error correction data, to align an image with a first side of a substrate;

determining that an inadequacy exists in process direction registration of the image on the first side of the substrate; and applying the skew and/or cross-process direction registration error correction data, and not applying the process direction registration error correction data, to align an image with a second side of the substrate.

2. The method of claim 1, further comprising:

determining a show-through error correction for the first side of the substrate; and not applying the show-through error correction to the second side of the substrate when the inadequacy exists.

3. The method of claim 1, wherein the physical feature comprises a substrate edge.

* * * * *